US006537438B2

(12) United States Patent
Christini

(10) Patent No.: US 6,537,438 B2
(45) Date of Patent: Mar. 25, 2003

(54) METHOD FOR PROTECTING ELECTRODES DURING ELECTROLYSIS CELL START-UP

(75) Inventor: Roy A. Christini, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 29 days.

(21) Appl. No.: 09/940,177

(22) Filed: Aug. 27, 2001

(65) Prior Publication Data

US 2003/0039759 A1 Feb. 27, 2003

(51) Int. Cl.[7] ..... C25D 5/10; C25D 5/12; C25C 7/00

(52) U.S. Cl. ..... 205/176; 205/177; 205/178; 205/181; 205/182; 204/247.3; 204/247.4; 204/290.07; 204/290.12; 427/113; 427/203; 427/250; 427/255.38; 427/404; 427/422; 427/419.7; 427/429; 427/430.1; 427/458

(58) Field of Search ..... 204/242, 243.1, 204/247.3, 247.4, 290.01, 290.07, 290.12; 205/159, 170, 176, 177, 178, 179, 180, 181, 182, 230, 231, 232, 233; 427/422, 446–456, 250–253, 189–193, 201–203, 205, 255.38, 255.391, 429, 457–486, 430.1–433, 113, 404, 419.1–419.4, 419.7

(56) References Cited

U.S. PATENT DOCUMENTS

| | | | | |
|---|---|---|---|---|
| 4,374,050 | A | 2/1983 | Ray | 252/519 |
| 4,374,761 | A | 2/1983 | Ray | 252/519 |
| 4,399,008 | A | 8/1983 | Ray | 204/67 |
| 4,455,211 | A | 6/1984 | Ray et al. | 204/293 |
| 4,582,585 | A | 4/1986 | Ray | 204/243 R |
| 4,584,172 | A | 4/1986 | Ray et al. | 419/34 |
| 4,620,905 | A | 11/1986 | Tarcy et al. | 204/64 R |
| 5,069,771 | A | 12/1991 | Nguyen et al. | 204/292 |
| 5,279,715 | A | 1/1994 | La Camera et al. | 204/64 R |
| 5,340,448 | A | 8/1994 | Sekhar et al. | 204/67 |
| 5,492,604 | A | 2/1996 | Ray | 205/375 |
| 5,534,130 | A | 7/1996 | Sekhar | 205/372 |
| 5,794,112 | A | 8/1998 | Ray et al. | 419/21 |
| 5,865,980 | A | 2/1999 | Ray et al. | 205/367 |
| 6,126,799 | A | 10/2000 | Ray et al. | 204/291 |
| 6,258,224 | B1 * | 7/2001 | Mirtchi | 204/247.3 |

* cited by examiner

*Primary Examiner*—Nam Nguyen
*Assistant Examiner*—Thomas H. Parsons
(74) *Attorney, Agent, or Firm*—Daniel P. Cillo; Glenn E. Klepac

(57) ABSTRACT

The present invention is directed to methods for applying a protective layer (42) to the cathode (40) of an electrolysis cell (10), where the cell also contains inert anodes (50) and the protective layer (42) can comprise a plurality of layers (70, 72, 74) with an inner layer (70) of $TiB_2$ being preferred, and the protective layer (42) protects the cathode (40)from hot gases (64) used to pre-heat the cell (10).

16 Claims, 1 Drawing Sheet

METHOD FOR PROTECTING ELECTRODES DURING ELECTROLYSIS CELL START-UP

FIELD OF THE INVENTION

The present invention relates to methods for start up of pots or cells used in the electrolytic deposition production of metals. More specifically, the present invention relates to methods for protecting electrodes, from thermal shock and degradation by products of combustion during pre-heating of molten salt electrolysis cells. The present invention further relates primarily to protecting cathodes and other carbon cell components during pre-heating.

BACKGROUND OF THE INVENTION

Aluminum is produced conventionally by the electrolysis of alumina dissolved in cryolite-based molten electrolytes at temperatures between about 900° C. and 1000° C.; the process is known as the Hall-Heroult process. A Hall-Heroult reduction cell typically comprises a steel shell having an insulating lining of refractory material, which in turn has a lining of carbon that contacts the molten constituents. Conductor bars connected to the negative pole of a direct current source are embedded in the carbon cathode substrate that forms the cell bottom floor. The carbon lining and cathode substrate have a useful life of three to eight years, or even less under adverse conditions. The deterioration of the cathode bottom is due to erosion and penetration of electrolyte and liquid aluminum as well as intercalation of sodium, which causes swelling and deformation of the cathode carbon blocks and ramming mix. In addition, the penetration of sodium species and other ingredients of cryolite or air leads to the formation of toxic compounds including cyanides. Anodes are at least partially submerged in the bath.

In operation, the conventional cell contains an electrolytic, molten cryolite-based bath in which alumina is dissolved. A molten aluminum pool acts as the cathode. A crust of frozen electrolyte and alumina forms on top of the bath and around the anode blocks. As electric current passes through the bath between the anode and cathode surfaces, alumina is reduced to aluminum, which is deposited in the pad of molten metal.

Electrolytic reduction cells must be heated from room temperature to approximately the desired operating temperature before the production of metal can be initiated. Heating should be done gradually and evenly to avoid thermal shock, which can in turn cause breakage or spalling of the anodes, sidewalls and cathode blocks. The heating operation minimizes thermal shock to the lining and the electrodes upon introduction of the molten electrolyte to the cell.

Preheating of cells is typically performed by either a gas preheat or by resistor block. The gas pre-heating step results in the generation of products of combustion (POC), such as at least one of CO, $CO_2$, and $H_2O$, which can be deleterious to the cathodes and anodes. CO can reduce the oxides in the anodes, eventually leading to corrosion. $CO_2$ and $H_2O$ can also oxidize the carbon in the cathode block, producing $CO+H_2$. $CO_2$ and $H_2O$ can oxidize metallic constituents of the anode, again leading to corrosion. It is therefore desirable to protect the cathodes and anodes from all constituents present in POC.

Aluminum electrolysis cells have historically employed carbon anodes on a commercial scale. The energy and cost efficiency of aluminum smelting can be significantly reduced with the use of inert, non-consumable, and dimensionally stable anodes. Use of inert anodes rather than traditional carbon anodes allows a highly productive cell design to be utilized, thereby reducing capital costs. Significant environmental benefits are also realized because inert anodes produce essentially no $CO_2$ or $CF_4$ emissions. Some examples of inert anode compositions are provided in U.S. Pat. Nos. 4,374,050; 4,374,761; 4,399,088; 4,455,211; 4,582,585; 4,584,172; 4,620,905; 5,279,715; 5,794,112; 5,865,980; and 6,126,799 assigned to Alcoa Inc. Inert anodes can undergo thermal shock if heated or cooled too quickly, and can also undergo degradation from exposure to POC.

It is well known to apply coatings to anodes to protect them during electrolysis; to provide a wetted bottom cathode surface or to repair or renew anode surfaces, as taught by U.S. Pat. Nos. 5,069,771 and 5,340,448. Cathodes have heretofore been protected according to the teachings of U.S. Pat. No. 5,492,604, using an aluminum paint containing at least aluminum powder and an organic binder, and a refractory metal source preferably selected from the elements titanium, zirconium, hafnium and their oxides to provide a metal-wettable coating. Aluminum foil appears to have been used as exterior cathode protection during heat-up. Also, as taught in U.S. Pat. No. 5,534,130, carbonaceous electrolytic cell components were treated with a solution of one or more phosphates of aluminum and one or more colloidal carriers. However, what is needed is a coating useful for pre-heat start-up of a new pot without damaging new carbon cathode cell bottoms or new cermet anodes already installed in the pot shell. What is needed is a new way to maintain the condition and surface of the original cathode and anode material so they do not need to be renewed or repaired.

In addition to attack of electrodes during pot startup, difficulties in operation can arise from the accumulation of undissolved alumina sludge on the surface of the carbon cathode material lying beneath the aluminum pool; this sludge can form insulating regions on the cell bottom. Penetration of cryolite, sodium and aluminum through the carbon body can result in deformation of the cathode carbon blocks and can also cause displacement of the blocks; this can give rise to other problems that negatively impact output of the cell.

A major drawback of carbon as a cathode material is that it is not wetted by aluminum. This necessitates maintaining a deep pool of aluminum (at least 100–250 mm thick) in order to ensure a certain protection of the carbon blocks and an effective contact over the cathode surface. Electromagnetic forces create waves in the molten aluminum and, to avoid short-circuiting with the anode, the anode-to-cathode distance ACD must be kept at a safe minimum value, usually 40 to 60 mm. For conventional cells, there is a minimum ACD below which the current efficiency drops drastically, due to short-circuiting between the aluminum pool and the anode.

SUMMARY OF THE INVENTION

The present invention is directed to methods for protecting electrodes during start up of metal producing electrolytic cells, or "pots" as they are referred to in the art, which utilizes a gas pre-heat. The entire pot and all its components should be carefully heated to temperature, and the gas atmosphere around the anodes and cathodes should be carefully controlled. More specifically, the gas atmosphere during heat-up should be maintained in a slightly oxidizing state, with enough oxidation to minimize carbon deposit or soot, but with not so much oxidation that exposed carbon will be attacked. Inert anodes are protected both from thermal shock and from products of combustion (POC) according to the present methods.

The present invention is directed to the application of a protective coating to the carbon cathode substrate forming the cell bottom floor, to protect it during gaseous pre-heating conditions. The coating is comprised of two or more layers including at least one layer selected from the group consisting of refractory material, metal, metal alloy and an outer carbon layer. Application of the coating minimizes early failure of the cathode and also, indirectly the inert anode, due to the effects of POC gases. A protective coating can optionally be applied to other carbon components prior to the pre-heating step; this serves to minimize reaction between the gas used in the preheat step and the carbon surfaces, thereby allowing for better control of the fuel to air ratio and better temperature control during heat-up. Better control of the fuel to air ratio permits better control of the oxygen partial pressure in the POC gas. Reduction or oxidation of the anode surface can be eliminated or controlled by careful control of the fuel to air ratio.

DETAILED DESCRIPTION OF PREFERRED EMBODIMENTS

Figure 1:
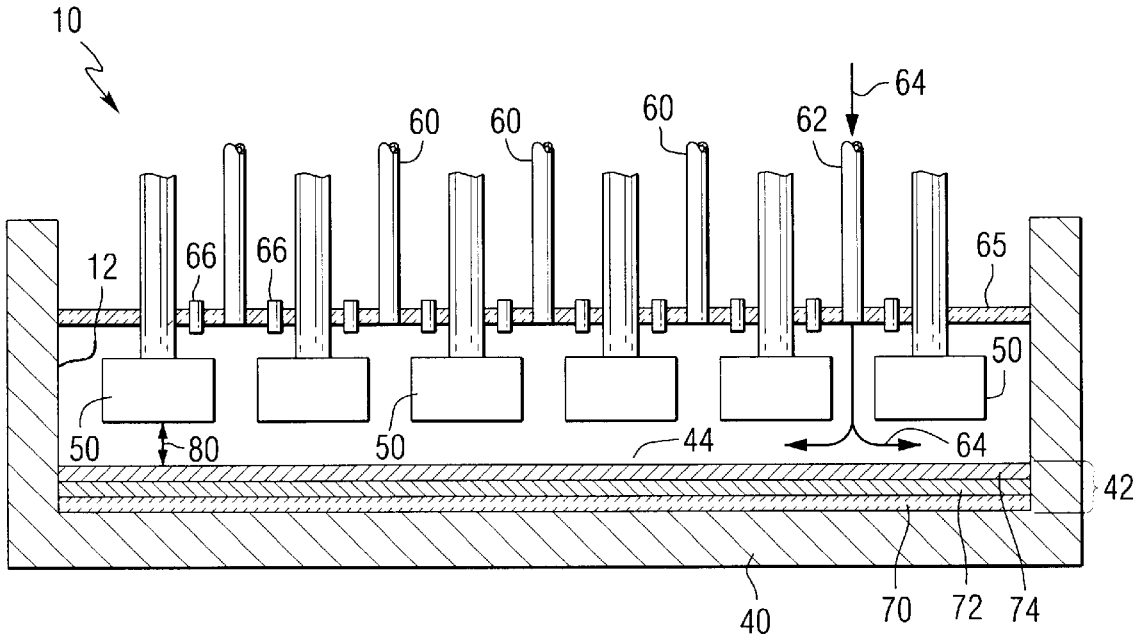
FIG. 1 is a partially schematic sectional view of an electrolytic cell for the deposition/production of aluminum including an inert anode, and a cathode bottom coated with a protective layer according to one embodiment of the present invention.

The present invention is generally directed to methods for treating the electrolytic cell cathode and other carbon components comprising applying to the components a material that forms a protective layer thereon. More specifically, the invention is directed to a method for treating the carbon cathode substrate cell bottom, comprising applying a protective coating of an inner layer of a refractory material, a middle layer of metal or metal oxide and an outer layer of carbon. The protective coating protects the cell components during the pre-heat step from attack by gaseous compounds.

"Inert anode" as used herein refers to a substantially nonconsumable anode that possesses satisfactory corrosion resistance and stability during the aluminum production process. Preferably, the inert anode is a cermet inert anode. "Cermet" refers to an inert anode comprising at least a ceramic phase and a metal phase. Inert anodes may be made entirely of a cermet material or can be a cermet material over a central metal core. When the cermet is provided as an outer coating its thickness is preferably about 0.1 mm to 50 mm, more preferably about 1 mm to 10 mm or 20 mm. The ceramic phase preferably makes up about 50 wt %–95 wt % of the cermet material, the metal phase about 5 wt %–50 wt %. More preferably, the ceramic phase comprises about 80 wt %–90 wt % of the cermet and the metal phase about 10 wt %–20 wt %.

The cermet inert anode has a ceramic phase that can be composed of any suitable oxide material including one or more metal oxides selected from the group consisting of Ni, Fe, Zn, Co, Al, Cu, Ti, V, Cr, Zr, Nb, Ta, W,Mb Hf, and any of the rare earth metal oxides and at least one additional oxide from the above list. A particularly preferred ceramic phase embodiment comprises iron, nickel, and zinc oxides. In this embodiment, the metal phase of the cermet material can comprise a base metal, such as Cu and/or Ag replaced in whole or in part by, or mixed or alloyed with, one or more metals selected from the group consisting of Co, Ni, Fe, Al, Sn, Nb, Ta, Cr, Mo, W, and the like. The metal phase may also comprise a noble metal such as one or more metals selected from Ag, Pd, Pt, Au, Rh, Ru, Ir, and Os. A preferred metal phase comprises copper as the base metal with the addition of at least one noble metal selected from Ag, Pd, Pt, Au, and Rh.

Application of the protective coating can be by any means known in the art, such as by successive dipping or immersing the cell in the protective material, or successive spraying or painting the bottom cell cathode with the protective material. More practical means of application include thermal spraying, electrocoating, electroless plating, physical vapor deposition, powder cementation, chemical vapor deposition, immersion, painting, and electrostatic spraying. A drying step can be employed following application of each of the layers constituting the protective coating. Multiple layers of similar or different compositions can be applied, with each layer being allowed to dry at least partially prior to addition of the next layer. Typically, the total protective coating on the cathode should be between about 0.1 mm to about 10.0 mm. For all embodiments of the present invention the protective coating can be applied to the entire carbon cathode substrate including cell sidewalls and cell bottom floor.

Any number of different refractory materials can be used in the protective coating. The material must be adherent to various carbon-containing substrates within the cell. The material should also have the desired mechanical, physical, chemical and electrochemical characteristics, such as being aluminum wettable and electrically conductive.

The refractory materials can be selected from one or more of the following compounds: metal borides of at least one metal selected from titanium, aluminum, zirconium, hafnium, vanadium, niobium, tantalum, nickel, molybdenum, chromium, tungsten, cobalt and iron, as well as intermetallic compounds. The refractory borides of titanium are preferred for the cathode coating, that is, titanium diboride ($TiB_2$). $TiB_2$ is practically insoluble in aluminum, has low electrical resistance and is wetted by aluminum.

The use of refractory materials, particularly $TiB_2$, that are wetted by aluminum allows aluminum to be electrolytically deposited directly on the cathode surface, and should avoid the necessity for a deep aluminum pool. In addition to being wettable by aluminum, many of the refractory metal borides, such as titanium diboride, are resistant to the corrosive environment of an aluminum production cell, and are good electrical conductors.

The protective coatings of the present invention are impervious and adherent to the carbon cathode component and resistant to thermal shock. Thus, the present methods provide the desired level of protection to carbon cathodes and during pre-heat, indirectly to inert anodes. By protecting the carbonaceous cell components from attack by NaF or other aggressive ingredients of the electrolyte, the cell efficiency is improved. Because NaF in the electrolyte no longer reacts with the carbon cell bottom and walls, the cell functions with a defined bath ratio without a need to replenish the electrolyte with NaF. The aluminum-wettable refractory coating will also permit the elimination of the thick aluminum pool required to partially protect the carbon cathode, enabling the cell to operate with a drained cathode.

The materials used in the present cathode protective coating protect the cathodic cell components on many levels. The carbonaceous cell components will be protected from attack by the gas used in the preheating step. During operation, the inner cathode protective layer will protect the cathodic cell components from the attack of molten aluminum, cryolite or air; the layer also minimizes the deformation of cathode blocks caused by the attack of sodium or air, which in turn prevents the formation of dangerous nitrogen compounds such as cyanides. Cell efficiency is also improved by applying the present cathode protective coating, as the NaF present in the electrolyte used for aluminum production will be protected by the inner cathode layer from reaction with the carbonaceous cell components. Thus, the NaF concentration in the electrolyte bath can be more readily controlled. The cathode protective layers used in the present invention result in prolonging the useful life of the components treated according to the present methods. "Protective coating" as used herein therefore refers to two or more layers that protect cell components from thermal shock, attack from gas, and/or attack from liquid.

An aluminum production cell 10 according to the present invention is depicted in FIG. 1. More specifically, FIG. 1 schematically illustrates one type of a simple electrolytic cell for the production of aluminum which include an inert anodes 50. The cathode 40 is coated with a protective coating 42 in accordance with an embodiment of the present invention. The protective coating is initially, preferably three separate deposited layers. This coating can cover the entire cathode 40 structure as shown or any portion thereof, such as bottom collection portion shown generally at 44 before cell operation. The protective coating can also cover other carbon components, such as inner crucible 12. Heating gas entry tubes 62 are shown, where hot heating gas 64 having POC such as CO, $H_2O$ and $CO_2$ from combustion of methane, natural gas or the like is used to pre-heat the cell. Gas flow is shown by arrows 64. This gas will contact the cathode protective coating 42 and other portions of the cell 10 such as anodes 50. An insulated cover 65 with vents 66 is located at the top cell covering to hold or exhaust the gas 64. The cell includes an inner carbon crucible 12 inside a protection crucible (not shown). A cryolite bath (not shown) would be contained in the inner crucible 12, and the cathode 40 is at the bottom of the bath. Alumina feed tubes 60 extend partially into the inner crucible 12 and are positioned above the bath. The top layer 74 of the cathode 40 and inert anode 50 are separated by ACD distance 80. Aluminum (not shown) produced during a run is deposited on the cathode 40 particularly in a collection portion on the bottom of the crucible 12. In addition to aluminum, the production cells of the present invention may also be useful in producing other metals such as lead, magnesium, zinc, zirconium, titanium, lithium, calcium, silicon, barium, strontium, scandium, niobium, vanadium, tantalium, tin, germanium, indium, hafnium, molybdenum, and the like, by electrolytic reduction of an oxide or other salt of the metal.

Figure 2:
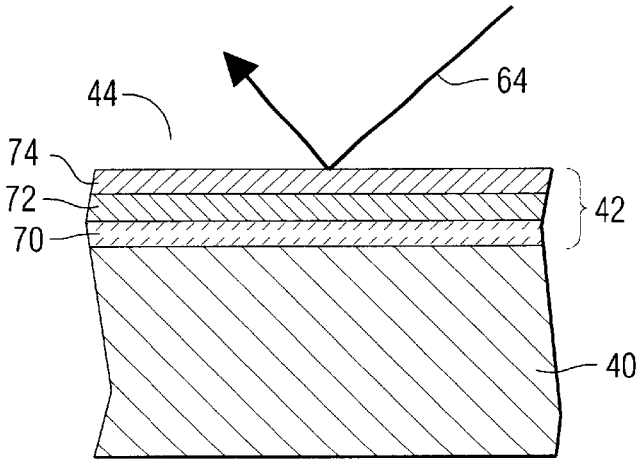
FIG. 2 is a cross-sectional view of a coating containing three protective layers covering the cathode.

FIG. 2 provides a partial cross-sectional view of the carbon cathode 40 bottom (not shown to scale) at, for example, 44 with pre-heat gas 64 contacting protective coating 42 during the pre-heat operation. The protective coating 42 will comprise plural layers, preferably three layers: inner layer 70 of a refractory material, most preferably $TiB_2$; middle layer 72 of the metal to be produced, usually aluminum, either as the metal or a metal alloy, such as Al and/or Al—Ti and outer carbon layer 74. During pre-heating, prior to introduction of any cryolite bath, oxygen, in the $H_2O$ or $CO_2$ of the POC will react preferentially with outer or exterior carbon layer 74 making the POC less oxidizing and therefore less harmful to the uncoated inert anode 50. This outer carbon layer 74, at the high temperature of the POC, from about 850° C. to 1000° C. will be consumed by the POC oxygen components leaving, for example, the Al or Al—Ti layer 72, which will also start to melt. Then, the cryolite bath can be added and the cell operated, usually from 900° C. to 980° C., and the inner Al or Al—Ti layer 72 will combine with the aluminum formed in the electrolysis cell, become part of the molten Al cathode layer and be recovered. The inner layer of refractory material, for example, $TiB_2$ will remain as a layer bonded to the carbon cathode blocks. Thus, the protective coating 42 is used to react with oxygen containing components of the pre-heat gas, usually combustion products of methane, natural gas or the like as an initial step before operation of the electrolysis cell, and to indirectly protect the inert anode from such gases. The aluminum, Al—Ti, or other metal or metal alloy inner layer will protect the refractory material, for example, $TiB_2$ from oxidation by the hot POC during heat-up, since $TiB_2$ itself will oxidize in hot POC gases. However, the heat transferred through the metal or metal alloy inner layer helps form an excellent bond of the refractory material to the carbon base cathode. The middle layer can be, for example, sheet aluminum or it can be applied by spraying, painting or any other suitable method.

Each layer of protective coating 42 can range from about 0.04 mm to about 5.0 mm thick, with a total thickness between 0.1 mm and about 10 mm. Preferably, the layer of refractory material will range from about 1 mm to 5 mm thick, as under 1 mm this last protective layer remaining during operation of the cell will not be thick enough to provide protection for the whole duration of the cell's life. $TiB_2$ has a finite solubility in molten aluminum and will slowly dissolve and disappear. $TiO_2$ and $B_2O_3$ additions to the cell/pot can prolong the life of the $TiB_2$ coating, but this is an additional expense and process step. Without regular additions, the life of the $TiB_2$ coating is directly a function of the original weight or thickness. Over 10 mm and this layer is difficult to apply in a fashion that produces a dense coherent layer. The metal or metal alloy middle layer will preferably range from 3 mm to 6 mm thick. Under 3 mm and the Al sheet does not necessarily cover the whole surface when the sheet melts. Over 6 mm and this layer becomes expensive to install due to the cost of plate Al. The outer carbon layer will preferably range from 0.1 mm to 1 mm thick. Under 0.1 mm and it is difficult to ensure that the whole Al surface will be adequately coated. Over 1 mm and this layer becomes expensive and unnecessary. Thick carbon layers are not needed if adequate fuel/air ratio control is utilized.

Reduction or oxidation of the anode 50 surface can be controlled by careful control of the fuel to air ratio used to produce the POC gas. Using a fuel to air ratio that is slightly fuel rich will produce a reducing gas composition which can slightly reduce the NiO phase in the inert anode to Ni metal. Using a fuel to ratio that is slightly air rich will produce an oxidizing gas composition which can oxidize the metallic copper to copper oxide.

Whereas particular embodiments of this invention have been described above for purposes of illustration, it will be evident to those skilled in the art that numerous variations of the details of the present invention may be made without departing from the invention as defined in the appended claims.

Having described the presently preferred embodiments, it is to be understood that the invention may be otherwise embodied within the scope of the appended claims.

What is claimed is:

1. A method for treating a carbon cathode in an electrolysis cell for producing metal comprising applying a protective coating to said cathode in a thickness of between about 0.1 mm and 10 mm, wherein said protective coating is comprised of two or more layers including at least one layer selected from the group consisting of refractory material, metal, metal alloy, and an outer carbon layer.

2. The method of claim 1, wherein an inert anode is also present in the electrolysis cell, and the electrolysis cell utilizes a gas pre-heat.

3. The method of claim 1, wherein said protective coating comprises at least one layer comprising $TiB_2$.

4. The method of claim 1, wherein said protective coating comprises three layers including an inner layer of metal boride contacting the carbon cathode, a middle layer selected from the group consisting of the metal to be produced and the alloy of the metal to be produced, and a carbon outer layer.

5. The method of claim 1, wherein each protective layer is applied in a thickness of between about 0.04 mm and about 5.0 mm, but where the protective coating is under 10 mm.

6. The method of claim 1, wherein said protective coating is effective to protect the cathode from hot gaseous pre-heat compounds used to pre-heat the cell and containing at least one of CO, $CO_2$ and $H_2O$, where oxygen in said compounds will react preferentially with the carbon layer.

7. The method of claim 6, where said cell also includes an inert anode and said inert anode is protected from oxidation due to reaction of the hot gaseous compounds with an outer carbon layer of the protective coating.

8. An aluminum production electrolysis cell comprising an inert anode, and a coated carbon cathode where the cathode is coated with a protective coating comprised of an inner refractory material, a middle layer selected from aluminum and aluminum alloy and an outer carbon layer.

9. The production cell of claim 8, wherein said inert anode is a cermet inert anode.

10. The production cell of claim 8, wherein said protective coating is directly applied to a surface of said cathode.

11. The production cell of claim 8, further comprising one or more additional cell carbon components that are coated with said protective coating.

12. The production cell of claim 8, further comprising:

a chamber containing a molten salt bath and alumina dissolved in said bath.

13. The production cell of claim 8, where said protective coating is effective to protect the cathode from hot gaseous compounds containing at least one of CO, $CO_2$ and $H_2O$ used to pre-heat the cell.

14. A method for treating a carbon cathode in an electrolysis cell for producing metal comprising applying to said cathode a protective coating comprising an inner layer of metal boride contacting the carbon cathode, a middle layer selected from the group consisting of the metal to be produced and an alloy of the metal to be produced, and a carbon outer layer.

15. The method of claim 14, wherein each layer in the protective coating is applied in a thickness between about 0.04 mm and about 5 mm, but where the protective coating has a thickness under 10 mm.

16. The method of claim 14, wherein said protective coating comprises at least one layer comprising $TiB_2$.

* * * * *